US005936597A

United States Patent [19]

Hyun et al.

[11] Patent Number: 5,936,597

[45] Date of Patent: Aug. 10, 1999

[54] CELL DRIVING DEVICE FOR USE IN FIELD EMISSION DISPLAY

[75] Inventors: Chang Ho Hyun; Oh Kyong Kwon, both of Seoul, Rep. of Korea

[73] Assignee: Orion Electric Co., Ltd., Kyungsangbuk-do, Rep. of Korea

[21] Appl. No.: 08/875,420

[22] PCT Filed: Nov. 30, 1996

[86] PCT No.: PCT/KR96/00225

§ 371 Date: Jul. 28, 1997

§ 102(e) Date: Jul. 28, 1997

[87] PCT Pub. No.: WO97/22133

PCT Pub. Date: Jun. 19, 1997

[30] Foreign Application Priority Data

Nov. 30, 1995 [KR] Rep. of Korea ..... 95-45454

[51] Int. Cl.[6] ..... G09G 3/02

[52] U.S. Cl. ..... 345/74; 345/75

[58] Field of Search ..... 345/74, 75, 76, 345/90

[56] References Cited

U.S. PATENT DOCUMENTS

| | | | |
|---|---|---|---|
| 5,103,145 | 4/1992 | Doran | 313/381 |
| 5,300,862 | 4/1994 | Parker et al. | 345/74 |
| 5,357,172 | 10/1994 | Lee et al. | 315/167 |
| 5,477,110 | 12/1995 | Smith et al. | 315/169.3 |
| 5,572,231 | 11/1996 | Kobori . | |
| 5,589,738 | 12/1996 | Onodaka et al. | 315/169.1 |
| 5,638,086 | 6/1997 | Lee et al. | 345/74 |
| 5,644,195 | 7/1997 | Browning | 315/169.3 |
| 5,656,892 | 8/1997 | Zimlich et al. | 345/204 |
| 5,808,425 | 9/1998 | Harle | 315/381 |
| 5,856,812 | 1/1999 | Hush et al. | 345/74 |

FOREIGN PATENT DOCUMENTS

| | | |
|---|---|---|
| 0 596 242 | 5/1994 | European Pat. Off. . |
| 2 707 032 | 12/1994 | France . |

*Primary Examiner*—Richard A. Hjerpe
*Assistant Examiner*—Jimmy Hai Nguyen
*Attorney, Agent, or Firm*—Thelen Reid & Priest LLP

[57] ABSTRACT

A cell driving device of a field emission display having a field emission pixel cell with a cathode (10) for emitting electrons and a gate electrode (12) for focusing and accelerating the electrons emitted from the cathode. The cell driving device includes: a first switching unit (14) for switching a first voltage (Vdd1) provided to the gate electrode (12); at least more than two transistors (18, 20, 22 and 24) for current control, which are in parallel connected to form a current mirror between the cathode and a second voltage (Vdd2); a voltage dividing unit coupled between a third voltage (Vdd3) and the second voltage (Vdd2) to drive the at least more than two transistors (18, 20, 22 and 24) for current control at the same voltage; at least more than two transistors for voltage switch each connected between the voltage dividing unit and the transistor for current control; and a controlling unit (38) for controlling at least more than two transistors (30, 32, 34 and 36) for voltage switch according to the size of a video signal (VS).

7 Claims, 2 Drawing Sheets

CELL DRIVING DEVICE FOR USE IN FIELD EMISSION DISPLAY

TECHNICAL FIELD

The present invention relates to a field emission element under use of cold-cathode and electric field, and more particularly to a cell driving device of a field emission display (hereinafter, called it "FED") which is capable of providing a gray level over a predetermined scale to a pixel by regulating the amount of current supplied to a cathode.

BACKGROUND ART

A cathode-ray tube (CRT) is a vacuum tube of a particular structure, which is useful to various electronic apparatus called a general display such as a television receiver, an oscilloscope, and a computer monitor. The original function of the CRT is to convert information included in an electric input signal into optical beam energy, which is then visibly displays the electric input signal.

In the CRT, the electrons emitted from the thermionic cathode are controlled by a control grid. The electronic beam through anode accelerates by magnetism or static electricity and deflects from a magnetic deflection coil or an electrostatic deflection coil on axes of the vertical or horizontal direction. Then, the electronic beam impacts upon a fluorescent film and is emitted as a visible ray for a while.

The input signal having information to be displayed is provided to a plurality of grids and cathodes. However, since beam current called gamma characteristic is a nonlinear function of control voltage, the more complicated compensating circuit should be disposed between the input signal and the plurality of grids to provide linear display intensity.

During the last several years, the trend is moving from a plate display towards development of a non-thermionic cathode, i.e., a field emission array.

The use of the field emission cathode array, instead of the conventional thermionic cathode in the CRT provides some merits. In particular, the use of the field emission cathode enables current density to be very high and lengthens the life of the CRT by eliminating a heat element.

However, according to the field emission cathode, the emission amount of electron for the input signal can be more non-linearly changed than in the thermionic cathode, so that there should be the a more complicated compensating circuit in the field emission cathode.

In order to solve such a problem, here are two cell driving devices of the FED, one of which is based on a passive matrix addressing method disclosed in U.S. Pat. No. 5,103,145 and proposed by Doran. The other is based on an active matrix addressing method disclosed in U.S. Pat. No. 5,210,472 and proposed by Casper.

According to the U.S. Pat. No. 5,103,145, the cell driving device of the FED in accordance with the passive matrix addressing method converts an input signal into a digital signal and linearly increases the emission amount of the electron by increasing the number of cathodes driven depending upon a logic value of the digital signal. In this case, more gray levels are implemented by the number of cathodes. Thus, it is difficult to embody the gray levels over a predetermined limitation because the number of cathodes to be installed in an occupying area of the cell could be limited.

In addition, the cell driving device of the FED in accordance with the passive matrix addressing method employs a voltage driving method which permits the electron to be emitted by voltage differential between the cathode and a gate. However, in this case, the current for voltage is changed non-linearly. Therefore, there may arise a problem may arise because it is hard to accurately regulate the amount of electrons emitted from the cathode.

On the other hand, the cell driving device of the FED according to the active matrix addressing method disclosed in the U.S. Pat. No. 210,472 is intended to drive pixels of high electric field under use of an integrated circuit consisting of CMOS or NMOS transistors and an input signal at a low voltage. Also, the cell driving device of the FED according to the active matrix addressing method uses a MOS transistor at a high voltage as a scan and a data switch in order to drive the cathode arranged in row lines and column lines. Further, the cell driving device of the FED according to the active matrix addressing method comprises fuses connected between a column driver and the cathode, a field effect transistor coupled between the cathode and the gate. The fuses limits the current so that overcurrent is not applied to the cathode. The field effect transistor used as a resistance regulates the amount of the electron emitted from the cathode by regulating the voltage differential between the cathode and the gate terminal through the adjustment of its own resistance value. Thereby, the light degree of the screen is adjusted. The column driver implements more gray levels by regulating the time required in driving the cathodes of the column lines, i.e., duty cycle.

However, the cell driving device of the FED according to the active matrix addressing method should use the MOS transistor for high voltage in order to switch a high-voltage supplied to scan and data lines. Further, the cell driving device of the FED according to the active matrix addressing method should be subjected to form a thick gate terminal of the field effect transistor coupled between the gate terminal and the cathode. Thereby, the cell driving device of the FED according to the active matrix addressing method needs more transistors than that of the FED according to the passive matrix addressing method and its manufacturing process is complicated.

Moreover, the number of adjustable duty cycles for implementing the more gray levels is limited, so that it is impossible to embody the gray levels over a predetermined limitation.

DISCLOSURE OF INVENTION

Accordingly, the present invention is directed to a cell driving device of a field emission display capable of implementing a gray level over a predetermined limitation by regulating the amount of current supplied to the cathode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the above object in accordance with the present invention, as embodied and broadly described, the cell driving device of the field emission display comprises a first switching unit for switching a first voltage provided to the gate electrode; at least more than two transistors for current control, which are in parallel connected to form a current mirror between said cathode and a second voltage; a voltage dividing unit coupled between a third voltage and the second voltage to drive the at least more than two transistors for current control at the same voltage; at least more than two transistors for voltage switch each connected between the voltage dividing unit and the transistor for current control; and a controlling unit for controlling the at least more than two transistors for voltage switch according to the size of a video signal.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

BEST MODE FOR CARRYING OUT THE INVENTION

Reference will now be made in detail to the preferred embodiments of the present invention, examples of which are illustrated in the accompanying drawings.

It will be apparent to those skilled in the art that various modifications and variations can be made in a cell driving device of the field emission display of the present invention without departing from the spirit or scope of the invention. Thus, it is intended that the present invention cover the modifications and variations of this invention provided they come within the scope of the appended claims and their equivalents.

Figure 1:
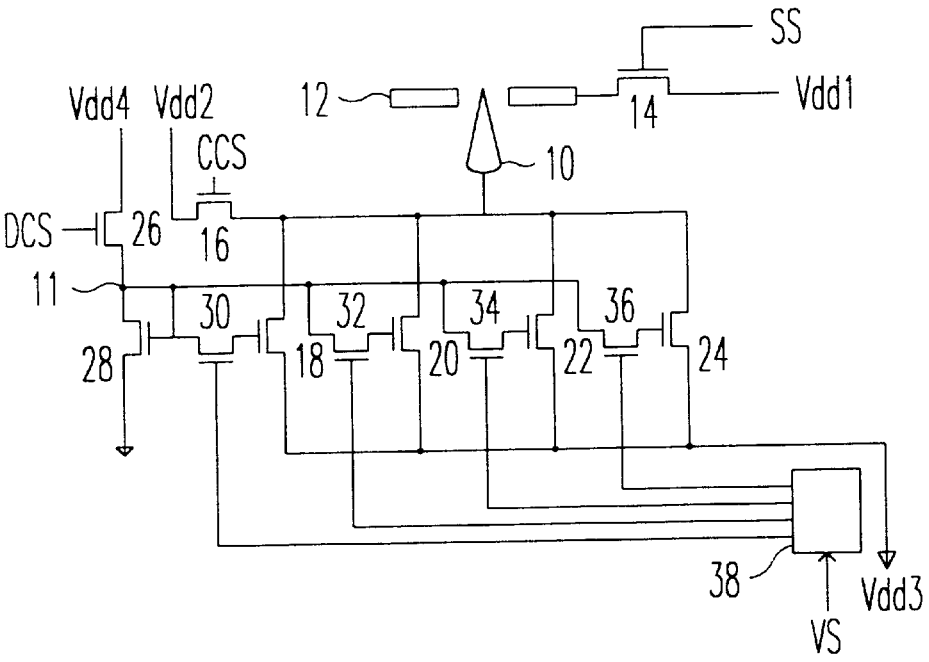
FIG. 1 is a circuit diagram of a cell driving device of a field emission display according to the embodiment of the present invention.

Referring to FIG. 1, a cell driving device of a field emission display a cathode 10, a gate electrode 12 for emitting electron from the cathode, a first NMOS transistor 14 for switching a first voltage Vdd1 provided to the gate electrode 12, and a second NMOS transistor 16 for switching a second voltage Vdd2 provided to the cathode 10 is provided.

The first NMOS transistor 14 is selectively driven according to the logic state of a scan signal SS. In more detail, in the case where the scan signal SS is maintained at the logic "high" level, the first NMOS transistor 14 is turned on and provides the first voltage Vdd1 to the gate electrode 12. At this time, the gate electrode 12 leads the field emission through the first voltage Vdd1 and emits the electrons from the cathodes 10. On the other hand, if scan signal is maintained at the logic "glow" level, the first NMOS transistor 14 is turned off, so that the first voltage Vdd1 is not provided to the gate electrode 12.

Figure 2:
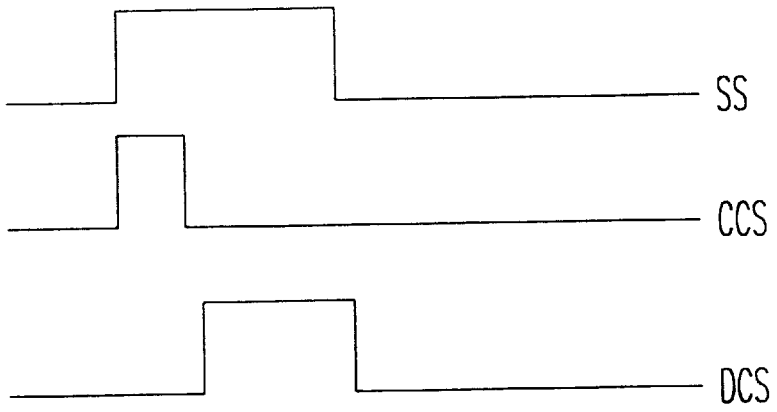
FIG. 2 is a timing diagram of a control signal supplied to the driving device shown in FIG. 1.

Meanwhile, the second NMOS transistor 16 is selectively driven according to the logic state of a charge control signal CCS. While the charge control signal CSS is maintained at the logic high level, the second NMOS transistor 16 provides the second voltage Vdd2 to the cathode 10 and also makes the cathode 10 a critical voltage state in an operation initialization just before the electron is emitted. Thereby, the cathode 10 directly emits the electrons at an operation start time without having a delay time. The charge control signal CCS, as shown in FIG. 2, has the same phase as the scan signal and also has a narrower pulse width than the scan signal at the logic "high" level.

The cell driving device of the FED comprises the third to sixth NMOS transistors 18, 20, 22, and 24 coupled between the cathode 10 and a third voltage Vdd3 in parallel, and the seventh and eighth NMOS transistors 26 and 28 coupled in series between a fourth voltage Vdd4 and the third voltage Vdd3 for generating driving voltages of the third to sixth NMOS transistors 18, 20, 22, and 24.

In response to a display control signal DCS, the seventh NMOS transistor 26 transfers the fourth voltage to a connecting node 11. In the case where the display control signal is maintained at the logic high level, the seventh NMOS transistor 26 is turned on and permits the fourth voltage Vdd4 to be transferred to the gate terminals of the third to sixth NMOS transistors 18, 20, 22, and 24 via the connecting node 11. The display control signal DCS, as shown in FIG. 2, has a pulse width ranging from a falling edge of the charge control signal CCS to that of the scan signal SS at the logic "high" level.

The eighth NMOS transistor 28 whose gate and drain terminals are commonly connected to the connecting node 11 and whose source terminal is coupled to the third voltage Vdd3, functions as one current controller. A resistance value of the eighth NMOS transistor 28 is determined by the width of its own channel or the doping thickness of its own channel. Further, the eighth NMOS transistor 28 functions as a voltage divider with the seventh NMOS transistor 26. The current value of the seventh NMOS transistor 26 is adjustable according to both a voltage level of the display control signal DCS and the width of its own channel.

Finally, when the display control signal DCS is maintained at the logic "high" level, the seventh and the eighth NMOS transistors 26 and 28 divide the voltage differential between the fourth voltage Vdd4 and the third voltage Vdd3, and then transmit the divided voltage to the gate terminals of the third to sixth NMOS transistors 18, 20, 22, and 24 via the connecting node 11.

While the divided voltage is applied to the gate terminals of the third to sixth NMOS transistors, the third to sixth NMOS transistors allow the constant amount of current to flow into the third voltage Vdd3 via the cathode 10. That is, the third to sixth NMOS transistors 18, 20, 22, and 24 generate the current signals of constant size, and then provide the signals to the cathode 10. However, at that moment, even though all of the current signals generated from the third to sixth NMOS transistors 18, 20, 22, and 24 can have the same size, it is desirable that the amount of the current is increased by $2^N$ (n=1,2,3, . . . ) from one current signal generated by the NMOS transistor 18 of least significant bit to the other generated by the NMOS transistor 24 of most significant bit. Therefore, it is also desired that the widths of channels of the fourth to sixth NMOS transistors 20, 22, and 24 should be each twice, four times, and eight times as large as that of channel of the third NMOS transistor 18. For example, if the amount of the current in the drain terminal of the third NMOS transistor 18 is 10 mA, the current of 20 mA, 40 mA, and 80 mA flow into the drain terminals of the fourth to sixth NMOS transistors 20, 22, and 24, respectively. That is, the third to sixth NMOS transistors 18, 20, 22, and 24 function as four current sources for providing the current signals of different size to the cathode 10.

In the meantime, the cell driving device of the FED further comprises the ninth to twelfth NMOS transistors 30 to 36 for switching the divided voltage applied to the gate terminals of the third to sixth NMOS transistors 18, 20, 22, and 24 from the connecting node 11, and a switch controlling part 38 for controlling the ninth to twelfth NMOS transistors 30, 32, 34, and 36.

Video signals VS inputted to the switch controlling part 38 are converted into the digital logic signals D0 to D3 of 4 bits in the switch controlling part 38. The switch controlling part 38 applies the digital logic signals D0 to D3 of 4 bits to the gate terminals of the ninth to twelfth NMOS transistors 30, 32, 34 and to 36. Therefore, the switch controlling part 38 can be implemented by an analog-digital converter or an encoder.

Figure 3:
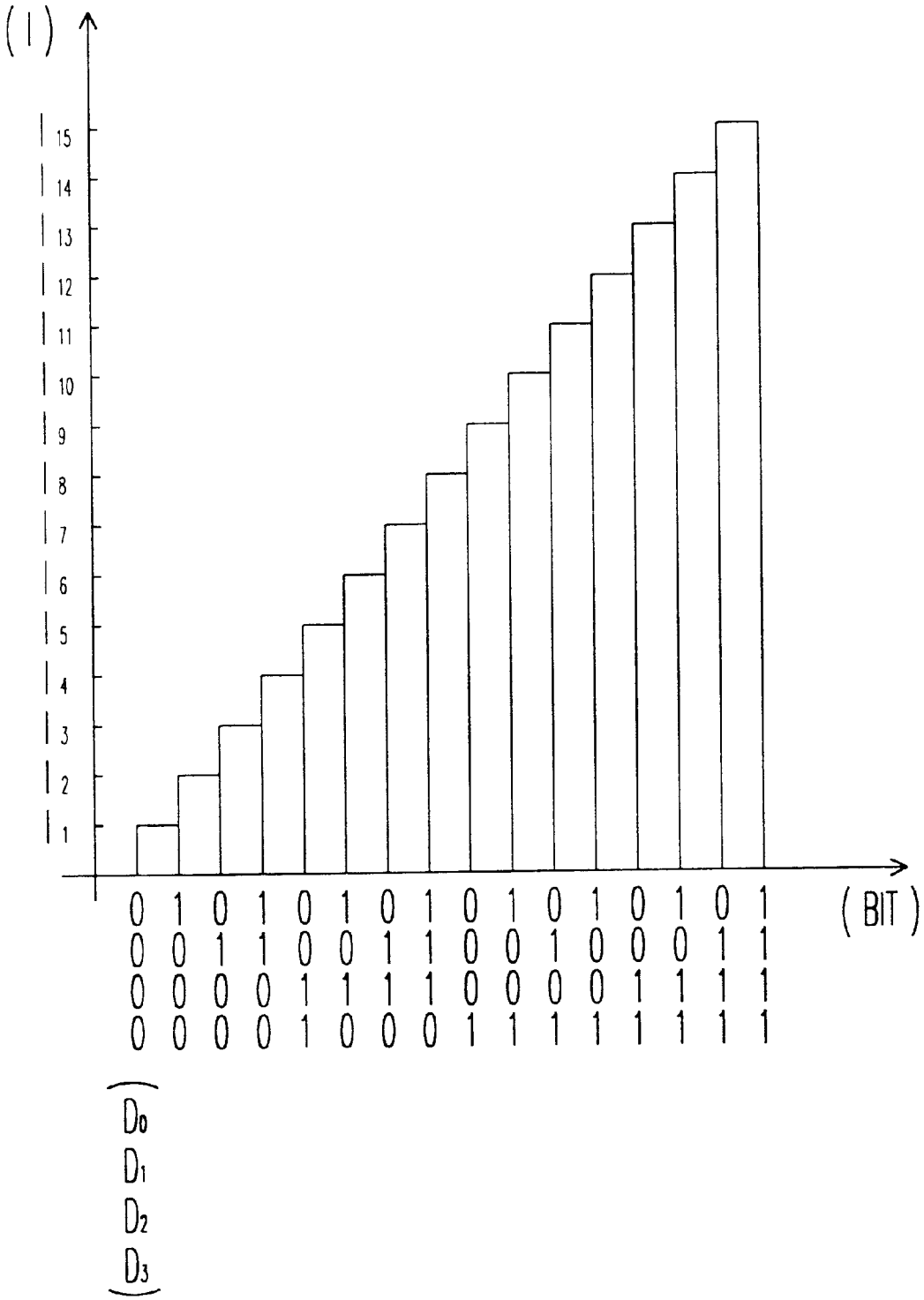
FIG. 3 is a diagram illustrating the size of current for an operating signal of a switching operation in the transistor shown in FIG. 1.

As shown in FIG. 3, the digital logic signals D0 to D3 of 4 bits can have a logic value such as "0 (0 0 0 0)" or, "15 (1 1 1 1)" according to the use of the differential current sources. On the other hand, the digital logic signals D0 to D3 of 4 bits can also have a logic value such as "0 (0 0 0 0)" or, "4 (0 0 1 0)" according to the size of the video signal. However, in order to achieve the high gray level, the former is required. In the meantime, in the case that the digital logic signals D0 to D3 of 4 bits are maintained at the logic "high" level, there is shown a logic value "1". Thereby, a part or all parts of the digital logic signals D0 to D3 of 4 bits can have the logic value "1" according to the size of the video signal, and they can also have the other logic value "0".

The ninth to twelfth NMOS transistors 30, 32, 34, and 36 are selectively driven depending upon the logic values of the digital logic signals D0 to D3 of 4 bits applied to their gate terminals, respectively and the third to sixth NMOS transistors 18, 20, 22, and 24 are thus selectively driven. Thereby, the amount of the current flowing into the cathode 10 is adjusted and the amount of the current emitted from the cathode 10 can also adjusted.

For example, if the logic values of the digital logic signals of 4 bits are given as "1", only the ninth NMOS transistor 30 is turned on and only the current path via the third NMOS transistor 18 is formed. Thereby, the current signal applied to the cathode 10 is 10 mA.

Also, if the logic values of the digital logic signals of 4 bits are given as "2", only the tenth NMOS transistor 32 is turned on and only the current path via the fourth NMOS transistor 20 is formed. Thereby, the current signal applied to the cathode 10 is 20 mA.

Further, if the logic values of the digital logic signals of 4 bits are given as "4", only the eleventh NMOS transistor 34 is turned on and only the current path via the fifth NMOS transistor 22 is formed. Thereby, the current signal applied to the cathode 10 is 40 mA.

Furthermore, if the logic values of the digital logic signals of 4 bits are given as "8", only the twelfth NMOS transistor 34 is turned on and only the current path via the sixth NMOS transistor 24 is formed. Thereby, the current signal applied to the cathode 10 is 80 mA.

Finally, if the logic values of the digital logic signals of 4 bits are given as "15", the ninth to twelfth NMOS transistors 30, 32, 34 and 36 are all turned on and the four current paths via the third to sixth NMOS transistors 18, 20, 22 and 24 are formed. Thereby, the current signal applied to the cathode 10 is 150 mA.

As mentioned above, the cell driving device of the FED of the present invention selectively drives at least more than two current sources for providing the different amount of the current signals to the cathode according to the size of the video signal, so that the amount of the current emitted from the cathode can be linearly changed with respect to the video signal. Therefore, in accordance with the present invention, some merits are that the number of cathodes included in the pixel is increased and the area occupied by the pixel is not limited, even though the gray level is raised. Further, the cell driving device of the FED according to the present invention can provide the shade of the predetermined gray level to the pixel, regardless of the area occupied by the pixel.

Meanwhile, in the above description, even though only an cathode is implemented in FIG. 1, it is well known to those skilled in the art that several hundreds or several thousands of cathodes can be mounted in one pixel. In addition, it can be understood that only one cathode explained in the embodiment of the present invention means several hundreds or thousands of cathodes connected commonly to each other.

In the embodiment of the present invention, even though the 16 gray levels are provided to the pixel, it is well known to those skilled in the art that the shade of 32 gray levels, 64 gray levels, and 124 gray levels can be provided to the pixel.

Accordingly, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A cell driving device of a field emission display having a field emission pixel cell with a cathode for emitting electrons and a gate electrode for focusing and accelerating said electrons emitted from said cathode, said cell driving device comprising:

a first switching unit for switching a first voltage provided to said gate electrode;

at least more than two transistors for current control, which are in parallel connected to form a current mirror between said cathode and a second voltage;

a voltage dividing unit coupled between a third voltage and said second voltage to drive said at least more than two transistors for current control at the same voltage;

at least more than two transistors for voltage switch each connected between said voltage dividing unit and said transistor for current control; and a controlling unit for controlling said at least more than two transistors for voltage switch according to the size of a video signal.

2. The cell driving device of a field emission display as claimed in claim 1, wherein said at least more than two transistors for current control have channels of different size so that current signals therethrough are maintained at a size of $2^n$ (n=1,2,3, . . . ) times.

3. The cell driving device of a field emission display as claimed in claim 2, wherein said controlling unit is subjected to selectively drive a part or all parts of said at least more than two current sources according to the size of said video signal.

4. The cell driving device of a field emission display as claimed in claim 3, wherein said controlling unit comprises an encoder for generating at least more than two bits of logic signal where a logic value "1" is gradually increased according to the size of said video signal.

5. The cell driving device of a field emission display as claimed in claim 3, wherein said controlling unit comprises an analog-digital converter for converting said video signal into at least more than two bits of digital logic signal.

6. The cell driving device of a field emission display as claimed in claim 1, further comprising a second switching unit for selectively providing a fourth voltage to said cathode and making said cathode a critical voltage state.

7. The cell driving device of a field emission display as claimed in claim 6, wherein said voltage dividing unit provides a dividing voltage to said two transistors for voltage switch while said second switching unit disconnects said fourth voltage applied to said cathode, and also provides said first voltage to said gate electrode while said first switching unit drives said second switching unit and said voltage dividing unit.

* * * * *